US005570590A

United States Patent [19]

Hansen et al.

[11] Patent Number: 5,570,590

[45] Date of Patent: Nov. 5, 1996

[54] REFRIGERANT RECLAIMING METHOD AND SYSTEM

[75] Inventors: Eigil Hansen, Sønderberg, Denmark; Donald W. Strout; Thomas L. Crandall, both of York, Pa.

[73] Assignee: A'Gramkow A/S, Sonderborg, Denmark

[21] Appl. No.: 401,263

[22] Filed: Mar. 9, 1995

Related U.S. Application Data

[63] Continuation of Ser. No. 19,659, Feb. 19, 1993, abandoned.

[51] Int. Cl.[6] ..... F25B 43/02

[52] U.S. Cl. ..... 62/472; 62/475; 62/292

[58] Field of Search ..... 62/195, 475, 472, 62/85, 292, 470, 473, 474, 77

[56] References Cited

U.S. PATENT DOCUMENTS

| | | | |
|---|---|---|---|
| 3,777,509 | 12/1973 | Muench | 62/470 |
| 4,169,356 | 10/1979 | Kingham | 62/475 |
| 4,304,102 | 12/1981 | Gray | 62/195 |
| 5,078,756 | 1/1992 | Major et al. | 62/149 |
| 5,377,501 | 1/1995 | Munston | 62/472 |

*Primary Examiner*—John M. Sollecito
*Attorney, Agent, or Firm*—Antonelli, Terry, Stout & Kraus

[57] ABSTRACT

An apparatus for reclaiming and purifying used refrigerant is comprised of a purification unit having a suction inlet for gaseous refrigerant and an outlet for fluid refrigerant. The suction inlet is connected through a suction accumulator in which remnants of oil are precipitated from the refrigerant and collected at the bottom of the accumulator. The outlet is connected to a collector tank for partially purified liquid refrigerant, an upper end portion of the collector tank is connected to the atmosphere through controllable means for blowing off non-condensable gases precipitated from the received liquid refrigerant. Means are provided for condensing out remnants of refrigerant from the blown-off gas from the collector tank before the gas is released to the atmosphere. An outlet in the bottom of the suction accumulator is connected to a separate underlying oil reservoir in which the precipitated oil, extracted from the used refrigerant in the oil separator, is collected. The reservoir is equipped with heater for heating the collected oil in the oil reservoir so as to boil out any refrigerant remaining therein, without heating of the oil in the oil separator.

8 Claims, 2 Drawing Sheets

REFRIGERANT RECLAIMING METHOD AND SYSTEM

This is a continuation of application Ser. No. 08/019,659 filed on Feb. 19, 1993, now abandoned.

BACKGROUND OF THE INVENTION

1. Field of the Invention

The present invention relates to a method and an apparatus for reclaiming and purifying used refrigerant. A primary field of application of the invention is the reclaiming of the refrigerant from small refrigeration units to be scrapped, e.g. household refrigerators and air conditioning units in abandoned cars, as well as the removal, purification and recharging of the refrigerant in connection with similar units still in operation.

2. Background of the Invention

As well known, refrigerants as known and used so far are considered dangerous for their ability to attack the stratospheric ozone layer, and it becomes increasingly required to eliminate or at least further minimize the amounts of refrigerant that are liable to escape into the air in connection with the processing of the reclaimed refrigerant. The processing may well take place in fully sealed systems, whereby purified refrigerant may be collected for renewed use, in general or by immediate recharging. However, it is almost inevitable that the purification gives rise to precipitation products that cannot be held isolated from the atmosphere, and generally the refrigerant will be well soluble in these products, whereby a minor fraction of the refrigerant will leave the sealed system and get exposed to the atmosphere anyway. The precipitation products, mainly, are oil and air or other non-condensable gases.

Oil is present in the refrigerant as a result of the serviced refrigeration system normally comprising a compressor that has to be lubricated. In normal operation the oil present in the compressed gaseous refrigerant will be precipitated in an oil separator and returned to the compressor, but still an operationally acceptable, small amount of oil will remain in the gas phase of the refrigerant and in the remaining circuit thereof, i.e. in the liquid phase as produced by a following condenser and then again in the gaseous phase as produced by an associated evaporator prior to the gaseous refrigerant being returned to the suction side of the compressor. When the refrigerant is drawn out of the unit for evaporation into the discussed processing system this residual oil will be drawn out as well, and inevitably it will contain a certain amount of dissolved refrigerant.

The refrigerant is transferred from the operative unit to the processing equipment by connecting a suction side of a compressor in the latter equipment to an accessible point of the refrigeration circuit of the former unit, whereby at least most of the refrigerant of that unit will evaporate and be sucked over to the processing equipment, however accompanied by the associated oil contents. The design of some refrigerant circuits will even allow liquid refrigerant mixed with the oil to enter the processing equipment. The processing equipment may be equipped with an oil separator for precipitating the oil, but the precipitant may still hold a considerable amount of dissolved refrigerant, which may thus escape into the air outside the closed system, when the contaminated oil is collected in an external system for disposal.

As mentioned, another contamination source will be the air or other non-condensable gases precipitated at the pressure side of the compressor of the processing system, as discussed in commonly assigned copending U.S. application Ser. No. 762,009. The transferred gas almost inevitably will contain some atmospheric air that will have to be precipitated from the closed system, but any such amount of air will inevitably hold a certain amount of the dangerous refrigeration gas, which will be released to the atmosphere along with the collected air, once the gas has been recycled and purified.

SUMMARY OF THE INVENTION

It has been found that the proportions of the refrigerant leaving the closed systems together with the said precipitation products are responsible for an unacceptable high content of refrigerant gas being delivered to the atmosphere. So far, in general, it has been presumed that the precipitation products were practically harmless, but this is not so, and according to the present invention care is taken to effect a real purification of the precipitants before letting them out to contact with the open air. This purification is effected by a separate treatment of the precipitants, whereby remaining amounts of refrigerant are extracted and caused to be returned to the main purification system.

As far as both the air and the oil is concerned the invention is based on the recognition that a highly efficient purification is achievable by techniques that are not basically very different from those used for separating the refrigerant from the precipitants in the first place, but upon isolation of the precipitants it is possible to apply such techniques in a more efficient manner without any disadvantageous effect in the main purification process. It is now a question of purifying the precipitants rather than purifying the refrigerant.

Thus, according to the invention, the contaminated oil collected in the oil separator of the processing equipment may be purified by a simple heating process, whereby any remaining refrigerant will be forced to evaporate from the oil. It is important, however, that this treatment should not take place in the oil separator container itself, but in a separate oil collector container, to which the oil is drained off from the separator, because the application of heat to the separator container would result in a decrease of the suction vapor pressure therein, whereby the main process would be adversely affected. The absolute vapor pressure should be as low as possible for ensuring a high suction effect onto the refrigerant system to be cleaned. On the other hand, the refrigerant evaporating from the isolated heated oil may be delivered directly to the suction side of the intake compressor of the processing equipment and thus later leave the system together with the remaining collection of purified refrigerant. The oil, thus cleaned for any remnants of refrigerant, may then be delivered to surroundings in open connection with the atmosphere.

As far as the precipitated air is concerned it is well known that this air may be blown off from the top of the container, in which the purified liquid refrigerant is collected. Inevitably, however, this air will be in admixture with some refrigerant in its gaseous phase, and although some measures can be taken to promote the blow-off of the air and other non-condensable gases while not promoting an associated blow-off of the refrigerant vapor, there will still be a certain small amount of refrigerant vapor in the blown-off air. According to the invention this is remedied in that the blow-off is effected not directly into the air, but into a special accumulator container, through a condenser in which the residual refrigerant gas will be condensed such that the accumulator container will hold all received refrigerant in its liquid phase, at a relatively low temperature by which the refrigerant is not liable to reevaporate so as to get mixed with the overlying non-condensable air and other gases.

Therefore, by a blow-off from the top of this accumulator container there will be no trace left of the refrigerant, and the liquid refrigerant as left at the bottom of the container may easily be suctioned into the main processing system by a simple bottom connection to the suction side of that system. Again, what is now endavoured to be purified is the precipitation product itself, with a connection to the main system for taking care of the polluting substance precipitated from the original precipitant.

BRIEF DESCRIPTION OF THE DRAWINGS

The invention, in the following, will be explained in more detail with reference to the drawings, in which.

DETAILED DESCRIPTION OF A PREFERRED EMBODIMENT

Figure 1:
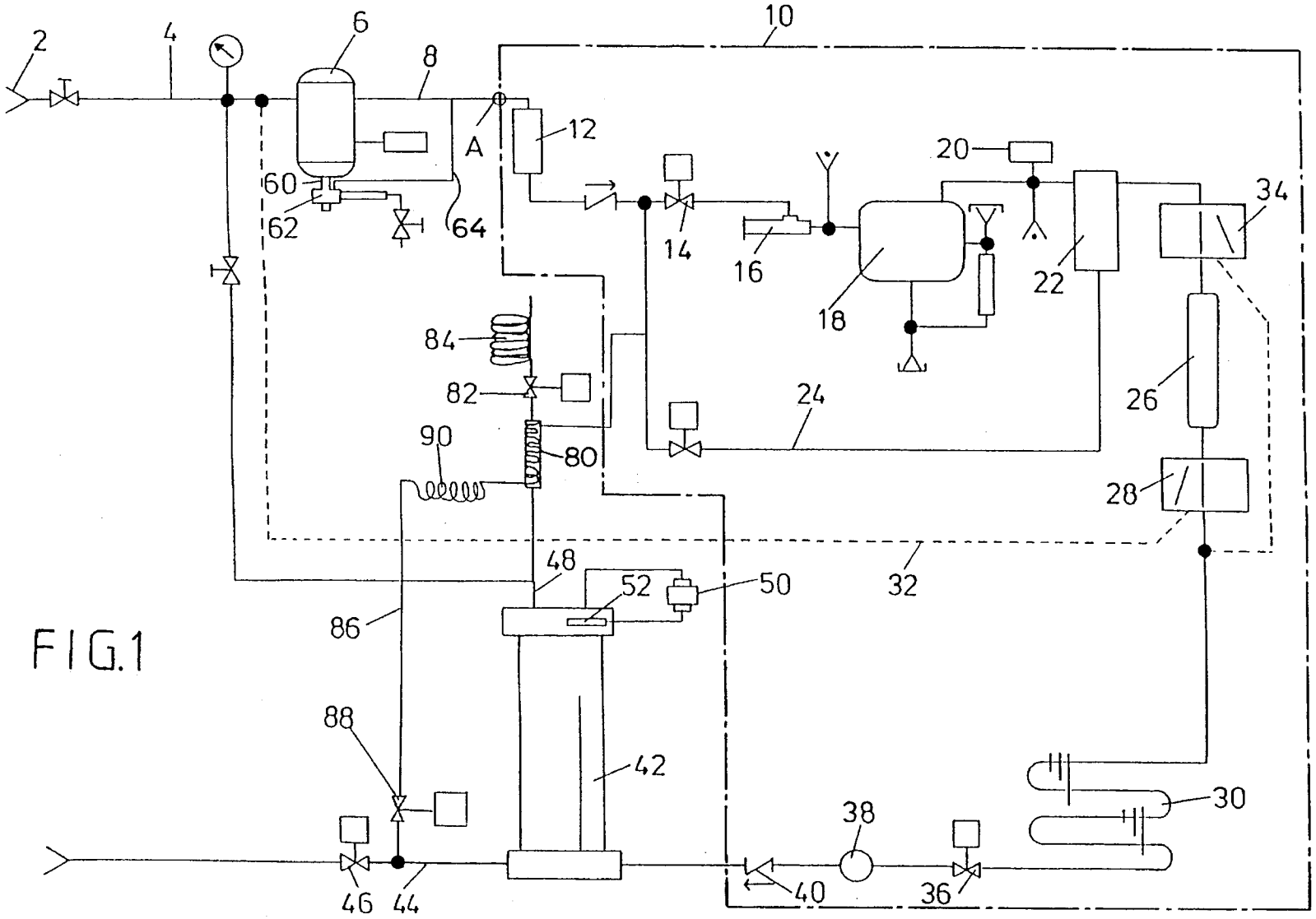
FIG. 1 is a schematic diagram of a reclaiming system according to the invention.

The reclaiming system illustrated by FIG. 1 is of a type basically disclosed in U.S. Pat. No. 5,094,087. It has an inlet port 2 for connection with any relevant unit, from which a refrigerant or some other volatile medium is to be reclaimed, an inlet pipe 4 leading to a suction accumulator 6 connected through a suction pipe 8 to an intake terminal A of a purification unit as shown within a dot-and-dash-frame 10.

Briefly, this unit 10 may comprise, in prolongation of the suction pipe 8, an acid filter 12, a suction valve 14, a suction pressure regulation unit 16, and a compressor 18 connected to this described suction system. The unit 10 further comprises, on the discharge side of the compressor 18, a high pressure control switch 20, an oil separator 22 sending back the majority of the collected oil through a pipe 24 to the suction side of the compressor 18, and a following purification filter 26 adapted to absorb various impurities in the gaseous phase of the processed refrigerant.

The filter 26 will need to be changed from time to time, and by such changings the outlet from the filter is connectable, through an outlet switch 28, either to an outlet condenser 30 or, through a return pipe 32, to the suction side of the compressor 18. In the latter case an inlet valve 34 at the inlet to the filter 26 is switched to by-pass the filter, for delivery of the gaseous product directly to the condenser 30. The latter mode of operation is selected whenever the filter 26 is due for renewal or cleaning.

From the condenser 30 the condensate is delivered, through a valve 36, a moisture indicator 38 and a check valve 40, to a collector tank 42, which can be emptied as desired through an outlet pipe 44 and a valve 46 therein.

In the collector tank 42 the purified condensate is collected in the manner described in copending U.S. application Ser. No. 762,009 i.e. together with a certain amount of atmospheric air and other non-condensable gases. Thus, in the upper portion of the tank 42 there will be held a mixture of condensable 'condensate gas' and non-condensable gases, and, in order to permit the tank to be gradually filled with the condensate, it is necessary to effect, from time to time, a blow-off of the non-condensable gas, because the pressure in the tank would otherwise rise to the condensation pressure in the condenser 30, whereby any further delivery of the condensate into the tank would be impossible. For reasons explained in the said copending application it is advantageous to control such a blow-off, through a blow-off pipe 48 and associated controlled valve means, governed by a differential pressure gauge so connected with the interior of the tank 42 and with a capsule 52, respectively, the latter holding an amount of the type of refrigerant to be purified and being arranged in heat conducting connection with the blow-off end of the tank 42.

So far described the disclosed system can be regarded as conventional. No matter how it may be modified within the frame 10, it will present two important problems, viz.:

The oil precipitated in the suction accumulator 6 may well be drained off from this accumulator, but the drained off oil is bound to show a certain content of the volatile refrigerant, which will escape to the air when the drained off oil is later on exposed to the open air; and The non-condensable gas as blown off from the tank 42 will hold a certain amount of the condensed condition.

In both cases the result will be an undesirable transfer of the refrigerant gas to the atmosphere, and it is the purpose of the present invention to minimize such a transfer.

As far as the oil precipitation is concerned, the suction accumulator 6, FIG. 1, is provided with a bottom outlet 60, through which the collected oil is normally drained off for removal. According to the invention, however, the outlet 60 communicates with an oil reservoir 62, in which there is arranged a heater element, by of which the collected oil can be heated for effectively driving out the contents of refrigerant therefrom. When heated, for example to 40°–60° C. the refrigerant will assume its gaseous phase, i.e. it will evaporate and be delivered to the suction side of the compressor either directly through the outlet 60 or preferably through a separate suction pipe 64 by passing the suction accumulator 6. Upon termination of a reclaiming operation the heat treated oil may be let out from the reservoir through a valve 66.

In many instances it is necessary to replenish to the serviced device an amount of fresh oil corresponding to the volume precipitated in the suction accumulator 6. It will be appreciated that a side effect of the invention is that it will be possible to measure this volume more accurately, once the residual content of refrigerant has been removed from the oil.

In order to secure an effective emptying of the oil reservoir 62 it can be desirable to apply a positive internal pressure in the suction accumulator 6, this being possible by opening a valve 68 in a pipe connection 70 from the blow-off pipe 48. The valve 68 should be closed again as soon as the oil has been pressed out, in order to prevent a release of refrigerant contaminated air to the atmosphere.

Figure 2:
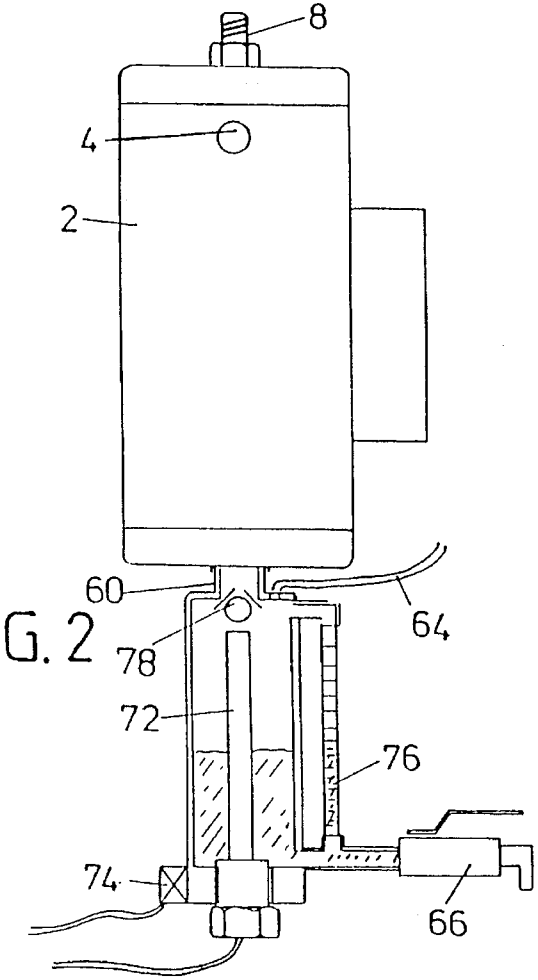
FIG. 2 is a lateral view of a first modified element thereof.

FIG. 2 illustrates a modified design of the oil reservoir 62, which is here an upright cylinder having a central heater rod 72 and a thermostat 74 for controlling the function of the heater. Moreover, a sight glass 76 is provided. Preferably, a one-way downlet valve 78 is mounted in the bottom outlet 60 from the suction accumulator.

While the oil is preferably heated by electrical heater means, it will be perfectly possible to arrange for heater means such as a pipe coil energized by hot gas directly from the warm part of the machine, i.e. from the part located between the compressor 18 and the condenser 30 of FIG. 1.

Thus, what is achieved is an extraction of residual refrigerant from the oil product, which, itself, has been extracted from the refrigerant to be purified, and a reintroduction of that residual refrigerant into the purification system. Exactly the same is endeavoured as far as the air product is concerned, and this will now be described with further reference to FIG. 1.

Even though the blow-off from the collector tank 42 is controlled by the differential pressure switch 50 there will still be traces of refrigerant in the air product. In accordance with this invention care is taken to ascertain that such remnants of refrigerant are effectively condensed out of the flow of otherwise non-condensable gas and returns to the closed processing system.

A first design of such a condensation system is shown in FIG. 1. The blow-off pipe 48 extends through a heat exchanger 80, a solenoid valve 82 and a capillarly tube 84, after which the pipe is in open connection with the atmosphere. The heat exchanger is mounted in a pipe connection 86 from the refrigerant outlet pipe 44 to the suction side of the compressor 18, through a valve 88 and a capillary tube 90.

In operation, whenever a blow-out occurs or is expected to occur, by opening of the valve 82, the valve 8 is opened. whereby a modest flow of liquid, pressurized refrigerant will be established through the capillary tube 90 to the heat exchanger 80, in which the liquid will meet with the suction pressure of the condenser. The liquid, already being a refrigerant, will evaporate by the low suction pressure and thus cause the heat exchanger 80 to operate as an evaporator chilling the blow-off gas flowing through the heat exchange. Hereby the refrigerant fraction of the blow-off gas will be effectively condensed, and the condensate will simply run down through the pipe 48, back to the tank 42. The capillary tube 84 serves to attenuate the gas flow when the valve 82 is opened so as to secure both an effective heat exchange in the unit 80 and a maintaining of the required high pressure in the tank 42 during the blow-off operation.

Figure 3:
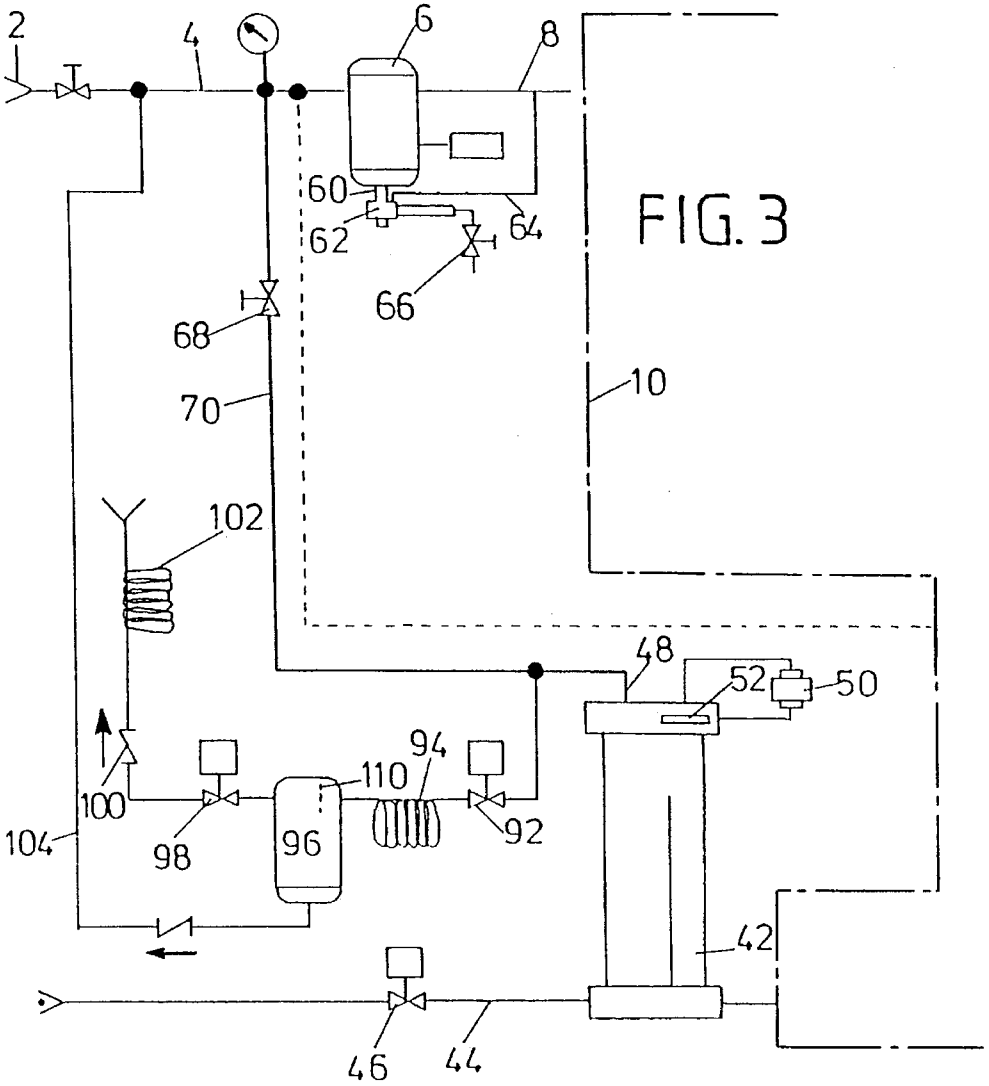
FIG. 3 is a schematic diagram of a modified part of the system.

A modified design of the system is shown in FIG. 3. The blow-off pipe 48 is connected to the atmosphere through a valve 92, a capillary tube 94, an accumulator tank 96, a valve 98, a check valve 100, and an outer capillary tube 102. In this case, when the valves 92 and 98 are opened for blow-off, a modest flow of the discussed blow-off gas will be established through the linear system, and having passed the capillary tube 94 this flow will meet a reduced pressure in the accumulator tank 96. The capillary tubes 94 and 102 are so adapted that this pressure will be above the relevant condensation pressure of the condensable fraction of the gas. By the associated expansion of the gas the temperature will decrease to below the condensation temperature of the condensable gas fraction, so this fraction will readily, by integral cooling, be converted to its liquid state and thus drop to the bottom of the tank 96 as an ordinary condensate. Through timed controlling of the two solenoid valves 94 and 98 optimal pressure conditions are obtainable in the tank 96.

The bottom of the accumulator tank 96 is connected, through a pipe 104, to the intake side of the main processing system, so the refrigerant precipitated in the tank is returnable to the system in this way. The tank 96 being in connection with the suction side of the compressor, condensed refrigerant will be suctioned from the tank whenever it is formed therein.

In operation, when gas is blown off from the collector tank 42 into the accumulator tank 96, it is of course important that practically all of the condensable gas fraction is retained or precipitated in the tank 96, this being widely possible by the condensation therein as already described. However, it has been found that the precipitation can be enhanced by providing, inside the tank 96, an impingement plate 110 just in front of the inlet from the pipe 48. When the gas mixture hits the plate 110 the refrigerant gas fraction, being heavier than the air and other non-condensable gases, tends to separate from the mixture and seek towards the bottom of the tank. At least when this is combined with the condensation there is a clear positive effect of the use of this arrangement, such that the blow-off gas is very effectively liberated for the residual refrigerant.

The impingement plate 110, of course, could be constituted by a tank wall portion located opposite to the gas inlet at a short spacing therefrom, but in that case the outlet opening for the final blow-off gas should be placed well spaced from this area, at the top of the tank.

We claim:

1. An apparatus for reclaiming and purifying used refrigerant, the apparatus comprising a purification unit having a suction inlet for intake of gaseous refrigerant and an outlet for fluid refrigerant, said suction inlet being connected through an oil separator in the form of a suction accumulator in which remnants of oil in the refrigerant are precipitated from said used refrigerant and collected in a bottom of the suction accumulator while said outlet is connected to a collector tank for at least partially purified liquid refrigerant, an upper end portion of said collector tank is connected to the atmosphere through controllable means for blowing off from said collector tank non-condensable gases precipitated from the received liquid refrigerant, means for condensing out remnants of refrigerant from the blown-off gas from said collector tank before the gas is released to the atmosphere, and wherein the oil separator includes an outlet in said bottom of said suction accumulator, said bottom outlet being connected to a separate, underlying oil reservoir in which the precipitated oil extracted from said used refrigerant in said oil separator is received by way of said bottom outlet in said suction accumulator and is collected, said reservoir is equipped with heater means for heating the collected oil in said oil reservoir so as to boil out any remnant of the refrigerant therein without effecting any corresponding heating of the separate oil separator, said oil reservoir at a top end thereof is connected to the suction inlet of the purification unit and at a bottom end thereof is connected to a valve controlled outlet operatively connected with the atmosphere for effectively providing a permissible degree of refrigerant content in the oil delivered to the atmosphere.

2. An apparatus according to claim 1, wherein the heating means associated with the oil reservoir are electrically energized.

3. An apparatus according to claim 1, wherein the heating means associated with the oil reservoir are energized by heat developed in said purification unit.

4. An apparatus for reclaiming and purifying used refrigerant, the apparatus comprising a purification unit having a suction inlet for intake of gaseous refrigerant and an outlet for fluid refrigerant, said inlet being connected through an oil separator in which remanents of oil in the refrigerant are precipitated, said outlet is connected to a collector tank for at least partially purified liquid refrigerant, an upper end portion of said collector tank is connected to the atmosphere through controllable valve means for blowing off from said collector tank non-condensable gases precipitated from the received liquid refrigerant, wherein a blow-off from said collector tank is passed through a condensation unit in which residuals of the refrigerant gas are condensed so as to flow back into the collector tank without escaping to the atmosphere, the oil separator includes a bottom connection to an underlying oil reservoir in which the precipitated oil is collected, said reservoir is provided with a heater means for heating the collected oil so as to boil out any remnant of the refrigerant therein without effecting any corresponding heating of the oil separator, said oil reservoir at a top end thereof is connected to the suction inlet of the purification unit and at a bottom end thereof is connected to a valve controlled oil outlet therefrom, wherein the blow-off from the collector tank to the atmosphere passes through a heat exchanger, a primary portion of the blow off is cooled by a connection between the liquid refrigerant delivered to or from the collector tank and the suction inlet of the purification unit in such a manner that the liquid refrigerant evaporates in the heat exchanger and effectively produces a condensation of a condensable fraction of the blow-off gas.

5. An apparatus according to claim 4, wherein a primary portion of the heat exchanger is cooled by respective inlet and outlet connections to delivery and intake sides of said purification unit.

6. An apparatus according to claim 4, wherein the heat exchanger includes a tank having an inlet opening connected through valve means with a top outlet opening of the collector tank and a lower outlet opening connected with the suction intake side of the purification unit, and wherein an upper outlet opening is connected to the atmosphere through valve means.

7. An apparatus for reclaiming and purifying used refrigerants, the apparatus comprising a purification unit having a suction inlet for intake of gaseous refrigerant and an outlet for fluid refrigerant, said suction inlet being connected through an oil separator in which remnants of oil in the refrigerant are precipitated, said outlet is connected to a collector tank for at least partially purified liquid refrigerant, an upper end portion of said collector tank is connected to the atmosphere through controllable means for blowing off from said collector tank non-condensable gases precipitated from the received liquid refrigerant, wherein the oil separator includes a bottom outlet connected to a separate, underlying oil reservoir in which the precipitated oil is collected, said reservoir is equipped with heater means for heating the collected oil so as to boil out any remnant of the refrigerant therein without effecting any corresponding heating of the separate oil separator, said oil reservoir at a top end thereof is connected to the suction inlet of the purification unit and at a bottom end thereof is connected to valve controlled oil outlet, a blow off from said collector tank is passed through a condensation unit in which residuals of the refrigerant gas are condensed so as to flow back into the collector tank without escaping to the atmosphere, and wherein a top of the oil reservoir is connected with the oil separator through a one-way outlet valve, while the upper end of the oil reservoir is connected to the suction intake of the purification unit by a pipe passing the oil separator.

8. An apparatus for reclaiming and purifying used refrigerant, the apparatus comprising a purification unit having a suction inlet for intake of gaseous refrigerant and an outlet for fluid refrigerant, said inlet being connected through an oil separator in which remnants of oil in the refrigerant are precipitated, said outlet is connected to a collector tank for at least partially purified liquid refrigerant, an upper end portion of said collector tank is connected to the atmosphere through controllable valve means for blowing off all non-condensable gases precipitated in said collector tank from the received liquid refrigerant to the atmosphere, and wherein a blow-off of all of the non-condensable gases from said collector tank is passed through a heat exchange unit in which residuals of refrigerant gas are condensed so as to flow back into the collector tank without escaping to the atmosphere, wherein the oil separator includes a bottom outlet connected to a separate, underlying oil reservoir in which the precipitated oil is collected, said reservoir is provided with heater means for heating the collected oil so as to boil out any remnant of the refrigerant therein without effecting any corresponding heating of the separate oil separator, said oil reservoir at a top end thereof is connected to the suction inlet of the purification unit and at a bottom end thereof is connected to a valve controlled oil outlet therefrom.

* * * * *